United States Patent [19]

Ochiai et al.

[11] Patent Number: 4,620,933

[45] Date of Patent: Nov. 4, 1986

[54] DEFLECTING YOKE FOR ELECTROMAGNETIC DEFLECTION TYPE CATHODE-RAY TUBES AND METHOD FOR MANUFACTURING IT

[75] Inventors: Kumi Ochiai, Yokohama; Hiromichi Horie, Yokosuka; Itsuo Arima, Kawasaki; Mikio Morita, Yokohama, all of Japan

[73] Assignee: Kabushiki Kaisha Toshiba, Kawasaki, Japan

[21] Appl. No.: 763,517

[22] Filed: Aug. 8, 1985

[30] Foreign Application Priority Data

Nov. 20, 1984 [JP] Japan ..... 59-243255

[51] Int. Cl.[4] ..... H01F 1/26

[52] U.S. Cl. ..... 252/62.54; 252/62.51; 252/62.53; 335/210

[58] Field of Search ..... 252/62.51, 62.54, 62.53

[56] References Cited

U.S. PATENT DOCUMENTS

| | | | |
|---|---|---|---|
| 4,264,361 | 4/1981 | Yajima et al. | 252/62.54 |
| 4,272,749 | 6/1981 | Tuji | 252/62.54 |
| 4,431,979 | 2/1984 | Stijntjes et al. | 335/210 |
| 4,497,722 | 2/1985 | Tsuchida et al. | 252/62.54 |
| 4,502,982 | 3/1985 | Horie et al. | 252/513 |
| 4,543,208 | 9/1985 | Horie et al. | 252/62.54 |
| 4,562,019 | 12/1985 | Inoue | 252/62.54 |

FOREIGN PATENT DOCUMENTS

| | | | |
|---|---|---|---|
| 0088992 | 9/1983 | European Pat. Off. . | |
| 2115536 | 10/1972 | Fed. Rep. of Germany . | |
| 3325972 | 2/1984 | Fed. Rep. of Germany | 252/62.54 |
| 47-41315 | 12/1972 | Japan . | |
| 48-51295 | 7/1973 | Japan . | |
| 59-41807 | 3/1984 | Japan | 252/62.51 |
| 59-123141 | 7/1984 | Japan . | |
| 2089371 | 11/1981 | United Kingdom . | |

OTHER PUBLICATIONS

European Search Report.

*Primary Examiner*—Arthur P. Demers
*Attorney, Agent, or Firm*—Schwartz, Jeffery, Schwaab, Mack, Blumenthal & Evans

[57] ABSTRACT

Disclosed are deflecting yoke for electromagnetic deflection type cathode-ray tubes which comprises a compressively molded products consisting substantially of an iron powder or an iron-based alloy magnetic powder; an electrically insulating powdery resin; an organic metallic coupling agent; and an electrically insulating powdery inorganic compound;

and a method for manufacturing it which comprises the steps of: mixing an iron powder or an iron-based alloy magnetic powder, an electrically insulating powdery resin and an organometallic coupling agent with one other; then mixing an electrically insulating powdery inorganic compound therewith; and compressively molding the prepared mixture.

The deflecting yoke of the present invention has more excellent properties, as compared with conventional ferrite cores and dust cores. Moreover, the deflecting yoke of the present invention can restrain the temperature rise more satisfactorily than the conventional deflecting yoke. Further, the deflecting yoke of the present invention can be manufactured with extreme ease and is suitable for mass production.

14 Claims, No Drawings

DEFLECTING YOKE FOR ELECTROMAGNETIC DEFLECTION TYPE CATHODE-RAY TUBES AND METHOD FOR MANUFACTURING IT

BACKGROUND OF THE INVENTION

The present invention relates to a deflecting yoke for electromagnetic deflection type cathode-ray tubes (hereinafter referred to as CRT) used in televisions and a variety of displays and a method for manufacturing it, and more particularly it relates to a deflecting yoke which is excellent in temperature stability and which is high in magnetic flux density, and a method for easily manufacturing it.

Heretofore, as materials for the deflecting yokes for the CRT, ferrite cores have often been employed from the viewpoint of frequencies used for deflection (e.g., Japanese Patent Publication No. 31557/1977 and Japanese Provisional Patent Publications Nos. 152298/1975 and 145996/1979).

However, in the usual ferrite core, a change in its magnetic properties owing to a temperature is as great as 20% or more even in the range of usable temperatures. Therefore, in the case that the ferrite core is utilized as the deflecting yoke for the CRT, its magnetic properties such as magnetic flux density disadvantageously will change under the influence of a variation of an ambient temperature, a temperature rise around the deflecting yoke during the operation of an instrument carrying the CRT, a temperature rise of a deflecting coil or the deflecting yoke itself due to a loss of them, and the like. For this reason, when the ferrite core is used as the deflecting yoke for the CRT, suitable measures will have to be taken to eliminate the above-mentioned disadvantage also on the side of the used instrument, so that it will be derived the problem that the instrument will become intricate in structure on the whole.

On the other hand, as a material having excellent temperature properties, so-called dust cores are known which may be manufactured, for example, by binding particles of a carbonyl iron powder with a phenolic resin or the like (e.g., Japanese Pat. Nos. 88779 and 112235).

These dust cores are excellent in temperature properties but their magnetic flux densities are 0.1 to 0.2 tesla (T) with respect to an excitation force of 10000 A/m, which value is smaller than that of the ferrite. If an attempt is made to provide necessary magnetic properties, the yoke will have to be enlarged in size, but at this time, there will be required more deflecting electric power than in the case of the ferrite. In consequence, these dust cores have scarcely been put into practice.

In view of the situations, Japanese Provisional Patent Publication No. 123141/1984 discloses a deflecting yoke comprising an iron powder or an iron alloy powder and a resin, by which the above-mentioned problems can be overcome.

Further, if the temperature rise in a yoke can be depressed than that of the deflecting yoke as described in Japanese Provisional Patent Publication No. 123141/1984 without impairing the advantages thereof, it will be considered that a deflecting yoke having high magnetic flux density and low temperature rise can be obtained.

When the temperature rise in a yoke was depressed by adding a third component to starting materials of the yoke, a fluidity of the starting materials would be lowered.

SUMMARY OF THE INVENTION

An object of the present invention is to provide a deflecting yoke for CRT which contains an iron powder or an iron-based alloy magnetic powder as a main component and which is more excellent in properties as compared with the above-mentioned deflecting yoke, and another object of the present invention is to provide a method for preparing the deflecting yoke with ease.

A deflecting yoke for CRT according to the present invention comprises a compressively molded products consisting essentially of an iron powder or an iron-based alloy magnetic powder; an electrically insulating powdery resin; an organometallic coupling agent; and an electrically insulating powdery inorganic compound, and a method for manufacturing the same according to the present invention comprises the step of: mixing an iron powder or an iron-based alloy magnetic powder, an electrically insulating powdery resin and an organometallic coupling agent with one another; then mixing an electrically insulating powdery inorganic compound therewith; and compressively molding the resulting mixture.

DESCRIPTION OF THE PREFERRED EMBODIMENTS

A deflecting yoke for CRT according to the present invention is a compressively molded products including the above-mentioned four kinds of components as essential constituents.

A first component is an iron powder or an iron-based alloy magnetic powder. An example of the usable iron powder is a pure iron powder, and examples of the usable iron-based alloy magnetic powders include powders of an Fe-Si series alloy, an Fe-Al series alloy, an Fe-Ni series alloy, an Fe-Co series alloy and an Fe-Al-Si series alloy. These powders can be used alone or in the form of a mixed powder prepared by suitably mixing two or more kinds thereof.

An average particle size of these magnetic powders preferably is between 10 μm or more and less than 100 μm. When the average particle size is less than 10 μm, a magnetic flux density of the obtained deflecting yoke will be poor and low; when it is 100 μm or more, eddy current loss in the inner portion of of the particle itself will increase and thus the loss of the deflecting yoke will increase, so that a temperature of the yoke will begin to excessively rise inconveniently.

A blending proportion of the iron powder or the iron-based alloy magnetic powder is preferably 65% or more, and more preferably in the range of 65% to less than 98.5%, based on the whole volume of the deflecting yoke. When the volume ratio of the powder is less than 65%, a magnetic flux density of the obtained deflecting yoke in an excitation force of 10000 A/m will decrease to a level of that of a ferrite; when it is more than 98.5%, a resin which will be described later will not completely insulate the magnetic powder between its particles, so that a loss of the obtained yoke will increase and will lead to an inconvenient temperature rise.

A second component of the deflecting yoke of the present invention is an electrically insulating powdery resin.

As the usable resin, any one may be acceptable so long as it has electrically insulating properties and binding properties, and examples of such resins include epoxy type resins, polyamide type resins, polyimide type resins, polycarbonate type resins, phenolic type resins, polysulfonate type resins, polyacetal type resins and polyester type resins. These resins may be used alone or as a mixture suitably containing two or more kinds thereof. Further, if a thermosetting resin is used, it is preferably used in a semi-curing state.

These resins all have a function of binding particles of the above-mentioned iron powder or iron-based alloy magnetic powder to one another, and simultaneously rendering the magnetic particles electrically nonconductive therebetween in order to decrease the loss of the obtained deflecting yoke and to thereby inhibit its temperature rise.

These resins may be used in a powdery form, but a particle size thereof preferably is at the same or a higher level as or than that of the aforesaid iron powder or iron-based alloy magnetic powder, that is, it is less than 100 μm. Further, a blending proportion of the resin is such that the above-mentioned iron powder or iron-based alloy magnetic powder is bound effectively to one another and is effectively rendered electrically nonconductive therebetween by the resin, and it is preferred that a volume ratio of the resin is 1% or more to the whole volume of the molded deflecting yoke.

Moreover, as the powdery resin, there may be used a powder prepared by dispersing, into the resin, a fine powder of an electrically insulating inorganic compound which is different from a fourth compound described later, and in this case, a less loss of the yoke can be expected.

Examples of such inorganic compounds include calcium carbonate, silica, magnesium, alumina and various glasses, and they may be used alone or by being suitably combined. However, these inorganic compounds are required to be nonreactive with the above-mentioned magnetic powder and powdery resin.

A third component of the deflecting yoke of the present invention is an organometallic coupling agent. When mixed with the above-mentioned iron powder or iron-based alloy magnetic powder and the powdery resin together, the third component functions to prevent a segregation of the resin and to form layers, having a high affinity to an organic compound, on the surfaces of the particles of the magnetic powder in the formed material after compression in order to heighten binding properties of the resin and thereby to noticeably improve electrically insulating properties of the particles of the magnetic powder. In particular, the addition of the coupling agent permits reducing the loss of the deflecting yoke more remarkably and restraining the temperature rise of the yoke more satisfactorily, as compared with the deflecting yoke disclosed in Japanese Provisional Patent Publication No. 123141/1984. A blending proportion of the organometallic coupling agent preferably is a volume ratio of 0.3% or more based on the whole volume of the molded deflecting yoke.

Such preferable organometallic coupling agents are materials in which a central atom is Ti, Si, Al, Zn, In or Cr and their examples include a titanate coupling agent represented by the general formula:

$$R^1{}_m\text{—Ti—}X_n$$

wherein $R^1$ is a group which is easy to be hydrolyzed, Ti is titanium, X is a lipophilic group, m is an integer of 1 to 4, n is an integer of 1 to 5, and m+n is 4 or 6;

a silane coupling agent represented by the general formula:

$$(R^2O)_p\text{—}\overset{(CH_3)_{3-p}}{\overset{|}{Si}}\text{—Y}$$

wherein $R^2$ is an alkyl group, Si is silicon, Y is an organic functional group and p is an integer of 2 or 3; and an aluminum coupling agent represented by the general formula:

$$(R^2O)_q\text{—Al—}X_{3-q}$$

wherein $R^2$ and X are the same as defined above, Al is aluminum and q is an integer of 1 or 2.

Example of the groups, represented by $R^1$, which are easily hydrolyzed in the above-mentioned formula include monoalkoxy groups such as an isopropoxy group; an oxyacetyl residue; an ethylene glycol residue; and the like.

Examples of the lipophilic groups represented by X include a carboxyl group, a phosphate group and a sulfonyl group each having a short-chain or long-chain hydrocarbon group or groups.

Examples of the alkyl groups represented by $R^2$ include alkyl groups having 1 to 4 carbon atoms, which may be substituted by an alkyl group such as a methyl group, an ethyl group, etc.

Examples of the organic functional groups represented by Y include substituted alkyl groups, cycloalkyl groups or alkoxy groups each substituted by a glycidoxy group, a substituted or unsubstituted amino group, a cycloalkyl group having epoxy group, and the like.

Concrete examples of the titanate coupling agents include titanate series coupling agent such as isopropyltriisostearoyl titanate, di(cumylphenylate)oxyacetate titanate, 4-aminobenzenesulfonyldodecylbenzenesulfonyl titanate, tetraoctylbis(ditridecylphosphite)titanate, isopropyltri(N-ethylamino-ethylamino)titanate (all trade names, titanate coupling agent, available from Kenrich-Petrochemicals. Inc.), and the like; concrete examples of the silane coupling agents include γ-glycidoxypropyltrimethoxy silane, β-(3,4-epoxycyclohexyl)ethyltrimethoxy silane, γ-aminopropyltriethoxy silane, N-(β-aminoethyl)-γ-aminopropylmethyldimethoxy silane (all trade names, silane coupling agent, avalable from Union Carbide, Shin-etsu Kagaku Kogyo K.K., etc.); and concrete examples of the aluminum coupling agents include acetoalkoxy aluminum diisopropylate (trade name, aluminum type coupling agent, available from Ajinomoto K.K.); and they can be employed alone or in a combination of two or more kinds thereof.

A fourth component is an electrically insulating powdery inorganic compound. When the three components mentioned above are mixed in a manufacturing process which will be described later, the resulting mixture is not so good in fluidity. Therefore, the fourth component functions to heighten this fluidity, whereby the mixture can easily and homogeneously be fed into a mold, which fact permits smoothing a compression molding and improving a density balance in the resulting molded products.

As the usable inorganic compound, any one is acceptable so long as it has electrically insulating properties, and preferable examples of such inorganic compounds include oxides such as $SiO_2$, $Al_2O_3$, $TiO_2$ and MgO; nitrides such as AlN, BN and $Si_3N_4$; carbides such as SiC and TiC; composite oxide such as $CaSiO_3$; and glasses having a variety of constituents. The suitable inorganic compound has a small concentration of a hydroxyl group on the surface of each particles thereof.

An average particle diameter of the powdery inorganic compound preferably is 0.5 μm or less at a primary particle, and if such a particle diameter requirement is sufficiently satisfied, even a relatively small proportion of the powdery inorganic compound to be added can provide a mixed powder rich in fluidity on the whole. Further, a blending proportion of the powdery inorganic compound preferably is a volume ratio of 0.1% or more based on the whole volume of the obtained deflecting yoke, depending upon the blending proportion of the organometallic coupling agent.

In the present invention, the reason why the fluidity of the mixture is improved by adding the above-mentioned fourth component is considered to be as follows: That is, the surface of each particle in the mixture of the first, second and third components is in a wet state owing to the addition of the organometallic coupling agent, and thus a frictional force between the particles themselves is great. However, when the fourth component is added thereto and is coated on the surface of the particles, the surfaces of the particles will return to a dry state and the fourth component will play as a so-called roller, so that the frictional force between the particles will be reduced to improve their fluidity noticeably.

The deflecting yoke according to the present invention may be manufactured as follows:

In the first place, the first, second and third components are mixed. In this case, these three components may be mixed simultaneously, alternatively the order of their addition may be at random. At this process, a three-component matrix which decides magnetic properties of the desired deflecting yoke is prepared.

Next, the fourth component is added thereto and mixed therewith in order to provide the above-mentioned matrix which is poor in fluidity with a high fluidity.

In the last place, the resulting mixture is filled into a mold having a predetermined shape, and a compression molding is then carried out. The mold may have a shape of the deflecting yoke for CRT or may be a divided mold which is divided into two or more.

A pressure which is applied at the time of the compression molding is such that the molded yoke is caused to have a high density, and such a pressure can generally be selected from the range of about 100 to about 1000 MPa. In this way, the desired deflecting yoke can be prepared, but after the compression molding, if necessary, a heat treatment may be additionally accomplished at a temperature of 70° to 300° C., preferably 120° to 250° C. in order to improve binding properties and insulating properties of the resin. Further, a hot-press method can also be used.

EXAMPLES 1 TO 8

(1) Preparation of a Deflecting Yoke

A magnetic powder, a powdery resin and an organometallic coupling agent which were shown in the following table were mixed at proportions (% by volume) in Table 1. In this process, it was not observed that the mixture dropped flowingly from a JIS Z 2504 standard flowmeter, which fact indicated that a fluidity of the mixture was not good.

Afterward, powdery inorganic compounds shown in Table 1 were added thereto in predetermined amounts, followed by mixing sufficiently for 0.25 hour. From each mixture, 50 g of a sample were taken out and tested on the above-mentioned flowmeter. The samples the whole amount of which flowingly dropped were indicated by white circles in Table 1.

The mixtures according to the present invention all were excellent in the fluidity.

Each mixture was fed into a given mold and a pressure of 600 MPa was applied thereto in order to carry out a compression molding. The resulting molded products was subjected to a heat treatment at 150° to 200° C. in order to prepare a deflecting yoke.

(2) Measurement of Magnetic Properties

For the respective deflecting yokes, a measurement of magnetic flux densities was made at an excitation force of 10000 A/m, and the results indicated that the magnetic flux densities all were 0.6 T or more. Further, for the respective deflecting yokes, a change in the magnetic flux densities was measured at the above-mentioned excitation force within the temperature range of 20° to 100° C., and according to the results, the change was 2% or less in all the samples. Furthermore, each deflecting yoke was incorporated into a television and was worked. At this time, values were shown in Table 1.

Comparative Examples 1 to 6

In the same manner as in Examples 1 to 8 except for using the starting material as shown in Table 1, deflecting yokes for comparative purpose were prepared.

As to these deflecting yokes, a measurement of magnetic properties as in Examples 1 to 8 was carried out in the same manner as mentioned above. The results are shown in Table 1 below.

TABLE 1

| | | Example 1 | Example 2 | Example 3 | Example 4 | Example 5 | Example 6 | Example 7 | Example 8 |
|---|---|---|---|---|---|---|---|---|---|
| Iron powder or iron-based alloy magnetic powder | Component | Fe | Fe | Fe—1.5% Si | Fe—1.5% Si | Fe—1.5% Si | Fe—9.5% Al—6% Si | Fe—3% Al | Fe—45% Ni |
| | Average particle diameter (μm) | 69 | 69 | 69 | 69 | 90 | 40 | 54 | 60 |
| | Proportion (volume %) | 90.0 | 90.0 | 98.0 | 90.0 | 90.0 | 70.0 | 90.0 | 90.0 |
| Powdery resin | Component | Epoxy | Epoxy | Epoxy | Epoxy | Poly-amide | Epoxy | Polycar-bonate | Epoxy |
| | Inorganic compound and proportion thereof | — | $CaCO_3$ 0.2 | — | — | — | — | — | $CaCO_3$ 0.2 |

TABLE 1-continued

| | | | | | | | | | |
|---|---|---|---|---|---|---|---|---|---|
| | (volume %) | | | | | | | | |
| | Proportion (volume %) | 9.15 | 8.75 | 1.6 | 9.1 | 9.3 | 27.85 | 8.2 | 8.6 |
| Organometallic coupling agent | Component | A* | A* | A* | A* | B* | C* | B* | A* |
| | Proportion (volume %) | 0.7 | 0.7 | 0.3 | 0.7 | 0.3 | 2.0 | 1.5 | 1.0 |
| Powdery inorganic compound | Component | $SiO_2$ | $SiO_2$ | $SiO_2$ | $Al_2O_3$ | $Si_3N_4$ | $TiO_2$ | $SiO_2$ | $SiO_2$ |
| | Average particle diameter (μm) | 0.02 | 0.02 | 0.02 | 0.4 | 0.2 | 0.3 | 0.02 | 0.02 |
| | Proportion (volume %) | 0.15 | 0.15 | 0.1 | 0.2 | 0.4 | 0.15 | 0.3 | 0.2 |
| Drop from flowmeter | | O | O | O | O | O | O | O | O |
| Temperature rise of yoke (°K.) | | 24 | 21 | 40 | 26 | 34 | 19 | 24 | 18 |

| | | Comparative example 1 | Comparative example 2 | Comparative example 3 | Comparative example 4 | Comparative example 5 | Comparative example 6 |
|---|---|---|---|---|---|---|---|
| Iron powder or iron-based alloy magnetic powder | Component | Fe | Fe—1.5% Si | Fe—1.5% Si | Fe—1.5% Si | Fe—1.5% Si | Fe |
| | Average particle diameter (μm) | 69 | 69 | 90 | 69 | 90 | 120 |
| | Proportion (volume %) | 90.0 | 99.0 | 99.0 | 98.0 | 90.0 | 98.0 |
| Powdery resin | Component | Epoxy | Epoxy | Polyamide | Epoxy | Epoxy | Epoxy |
| | Inorganic compound and proportion thereof (volume %) | — | — | — | — | — | — |
| | Proportion (volume %) | 9.3 | 1.0 | 9.6 | 2.0 | 9.65 | 1.6 |
| Organometallic coupling agent | Component | A* | — | — | — | B* | A* |
| | Proportion (volume %) | 0.7 | — | — | — | 0.3 | 0.3 |
| Powdery inorganic compound | Component | — | — | $Si_3N_4$ | | $Al_2O_3$ | $SiO_2$ |
| | Average particle diameter (μm) | — | — | 0.2 | — | 0.4 | 0.02 |
| | Proportion (volume %) | — | — | 0.4 | — | 0.05 | 0.1 |
| Drop from flowmeter | | X | O | O | O | X | O |
| Temperature rise of yoke (°K.) | | 23 | 73 | 44 | 49 | 34 | 60 |

A*: Tetraoctylbis(ditridecylphosphite)titanate
B*: γ-Aminopropyltrimethoxysilane
C*: Acetoalkoxyacylaluminum diisopropylate As is definite from Examples and Comparative Examples just described, with regard to the deflecting yokes for the CRT according to the present invention, the magnetic flux densities are high, the change in the magnetic flux densities is remarkably less, and the temperature rise is small even when they are incorporated into the televisions. From these results, it can be concluded that the deflecting yoke of the present invention has more excellent properties, as compared with conventional ferrite cores and dust cores. Moreover, the deflecting yoke of the present invention can restrain the temperature rise more satisfactorily than the deflecting yoke of Japanese Provisional Patent Publication No. 123141/1984, which fact means that the yoke of the present case can be used under severer conditions.

In addition thereto, the deflecting yoke of the present invention can be manufactured with extreme ease and is suitable for mass production. In consequence, it can be appreciated that the deflecting yoke of the present invention is very beneficial and convenient from a standpoint of industrical applications.

We claim:

1. A deflecting yoke for an electromagnetic deflection type cathode-ray tube which comprises a compressively molded products consisting essentially of an iron powder or an iron-based alloy magnetic powder; an electrically insulating powdery resin; an organometallic coupling agent; and an electrically insulating powdery inorganic compound.

2. A deflecting yoke for an electromagnetic deflection type cathode-ray tube according to claim 1, wherein a blending proportion of said iron or iron-based alloy magnetic powder is between 65% or more and less than 98.5% based on the whole volume of said deflecting yoke.

3. A deflecting yoke for an electromagnetic deflection type cathode-ray tube according to claim 1, wherein said organometallic coupling agent is an organometallic coupling agent in which a central atom is any one of titanium, silicon, aluminum, zirconium, indium and chromium.

4. A deflecting yoke for an electromagnetic deflection type cathode-ray tube according to claim 3, wherein a blending proportion of said organometallic coupling agent is a volume ratio of 0.3% or more based on the whole volume of said deflecting yoke.

5. A deflecting yoke for an electromagnetic deflection type cathode-ray tube according to claim 1, wherein said organometallic coupling agent is one selected from the group consisting of a titanate coupling agent represented by the general formula:

$$R^1{}_m\text{—Ti—}X_n$$

wherein $R^1$ is a group which is easy to be hydrolyzed, Ti is titanium, X is a lipophilic group, m is an integer of 1 to 4, n is an integer of 1 to 5, and m+n is 4 or 6;

a silane coupling agent represented by the general formula:

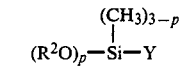

wherein $R^2$ is a substituted or unsubstituted alkyl group, Si is silicon, Y is an organic functional group and p is an integer of 2 or 3; and an aluminum coupling agent represented by the general formula:

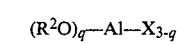

wherein $R^2$ and X are the same as defined above, Al is aluminum and q is an integer of 1 or 2.

6. A deflecting yoke for an electromagnetic deflection type cathode-ray tube according to claim 1, wherein a primary average particle diameter of said electrically insulating powdery inorganic compound is 0.5 μm or less.

7. A deflecting yoke for an electromagnetic deflection type cathode-ray tube according to claim 6, wherein a blending proportion of said electrically insulating powdery inorganic compound is a volume ratio of 0.1% or more based on the whole volume of said deflecting yoke.

8. A method for manufacturing a deflecting yoke for an electromagnetic deflection type cathode-ray tube which comprises the steps of:

mixing an iron powder or an iron-based alloy magnetic powder, an electrically insulating powdery resin and an organometallic coupling agent with one other; then mixing an electrically insulating powdery inorganic compound therewith; and compressively molding the prepared mixture.

9. A method for preparing a deflecting yoke for an electromagnetic deflection type cathode-ray tube according to claim 8, wherein a blending proportion of said iron or iron-based alloy magnetic powder is between 65% or more and less than 98.5% based on the whole volume of said deflecting yoke.

10. A method for preparing a deflecting yoke for an electromagnetic deflection type cathode-ray tube according to claim 8, wherein said organometallic coupling agent is an organometallic coupling agent in which a central atom is any one of titanium, silicon, aluminum, zirconium, indium and chromium.

11. A method for preparing a deflecting yoke for an electromagnetic deflection type cathode-ray tube according to claim 8, wherein a blending proportion of said organometallic coupling agent is a volume ratio of 0.3% or more based on the whole volume of said deflecting yoke.

12. A method for preparing a deflecting yoke for an electromagnetic deflection type cathode-ray tube according to claim 8, wherein a blending proportion of said organometallic coupling agent is a volume ratio of 0.3% or more based on the whole volume of said deflecting yoke.

13. A method for preparing a deflecting yoke for an electromagnetic deflection type cathode-ray tube according to claim 8, wherein a primary average particle diameter of said electrically insulating powdery inorganic compound is 0.5 μm or less.

14. A method for preparing a deflecting yoke for an electromagnetic deflection type cathode-ray tube according to claim 8, wherein a blending proportion of said electrically insulating powdery inorganic compound is a volume ratio of 0.1% or more based on the whole volume of said deflecting yoke.

* * * * *